United States Patent [19]

Kurtz

[11] Patent Number: 4,728,376

[45] Date of Patent: Mar. 1, 1988

[54] EXPLOSIVE COMPOSITION AND METHOD

[75] Inventor: Earl F. Kurtz, Las Vegas, Nev.

[73] Assignee: Golden Power of Texas, Inc., Dallas, Tex.

[21] Appl. No.: 890,146

[22] PCT Filed: Oct. 10, 1984

[86] PCT No.: PCT/US84/01647

§ 371 Date: May 30, 1986

§ 102(e) Date: May 30, 1986

[87] PCT Pub. No.: WO86/02347

PCT Pub. Date: Apr. 24, 1986

Related U.S. Application Data

[63] Continuation-in-part of Ser. No. 437,965, Nov. 1, 1982, Pat. No. 4,497,676.

[51] Int. Cl.[4] ..... C06G 45/02

[52] U.S. Cl. ..... 149/21; 149/2; 149/45; 149/46; 149/61; 149/109.6; 102/431; 102/700; 264/3 R; 264/3 C; 264/3.4

[58] Field of Search ..... 149/2, 21, 46, 45, 61, 149/109.6; 102/431, DIG. 700; 264/3 R, 3 C

[56] References Cited

U.S. PATENT DOCUMENTS

| | | | |
|---|---|---|---|
| 1,056,365 | 3/1913 | Raschig | 149/61 |
| 3,296,044 | 1/1967 | Gebrig et al. | 149/47 |
| 3,361,604 | 1/1968 | Griffith et al. | 149/44 |
| 3,397,637 | 8/1968 | Bobinski et al. | 102/38 |
| 3,485,686 | 12/1969 | Jessop et al. | 149/41 |
| 3,557,700 | 1/1971 | Quinlan | 102/38 |
| 3,670,649 | 6/1972 | Hartlein et al. | 102/38 |
| 3,730,094 | 5/1973 | Quinlan | 102/38 |
| 3,862,866 | 1/1975 | Timmerman et al. | 149/85 |
| 3,901,153 | 8/1975 | Brabets et al. | 102/38 |
| 3,908,509 | 9/1975 | Kelly et al. | 86/1 R |
| 3,910,805 | 10/1975 | Catantarite | 149/83 |
| 3,919,940 | 11/1975 | Ploger et al. | 102/333 |
| 3,925,122 | 12/1975 | Berthmann et al. | 149/2 |
| 3,964,255 | 6/1976 | Catanzarite | 60/205 |
| 3,971,729 | 7/1976 | Timmerman | 252/187 R |
| 3,987,731 | 10/1976 | Brzuskiewicz | 102/431 |
| 3,994,235 | 11/1976 | Politzer et al. | 102/101 |
| 4,025,591 | 5/1977 | Pendergast | 264/3 R |
| 4,068,589 | 1/1978 | Oversohl | 102/465 |
| 4,080,411 | 3/1978 | Stanley | 264/3 B |
| 4,128,443 | 12/1978 | Pawlak et al. | 149/71 |
| 4,137,286 | 1/1979 | Bornstein | 264/3 R |
| 4,140,562 | 0/0000 | Gualillo | 149/19.1 |
| 4,179,404 | 12/1979 | Barone | 252/435 |
| 4,356,769 | 11/1982 | Galluzzi | 102/380 |
| 4,427,465 | 0/0000 | Gonzalez | 149/2 |
| 4,497,676 | 2/1985 | Kurtz | 149/109.6 |

FOREIGN PATENT DOCUMENTS

| | | |
|---|---|---|
| 2022468 | 5/1964 | France . |
| 4509 | of 1897 | United Kingdom . |
| 9111 | of 1898 | United Kingdom . |
| 796154 | 6/1958 | United Kingdom . |

OTHER PUBLICATIONS

Kit, Boris and Douglas S. Evered, Rocket Propellant Handbook, New York, N.Y.: The Macmillan Company, 1960, pp. 148–151.

*Primary Examiner*—Stephen J. Lechert, Jr.
*Attorney, Agent, or Firm*—Shoemaker and Mattare, Ltd.

[57] ABSTRACT

Certain classes of organic acids, and salts of those acids and in particular ascorbic acid and erythorbic acid and the salts thereof, and mixtures thereof, which have certain antioxidant and food preservative properties, have been found to be capable of being reacted together with sources of nitrate, including inorganic nitrates, ammonium nitrate, organic nitrates, and the like, at temperatures below 480° F. to produce compositions which are capable of being molded into specific shapes or used in a powdered form as a gunpowder substitute, an explosive or a propellent when properly ignited.

35 Claims, 2 Drawing Figures

EXPLOSIVE COMPOSITION AND METHOD

This application is a continuation-in-part of U.S. patent application Ser. No. 437,965 filed Nov. 1, 1982 now U.S. Pat. No. 4,497,676.

BACKGROUND OF THE INVENTION

This invention relates to a novel combustible and explosive compositions useful as substitutes for previous gunpowder-based compositions as well as other combustible formulations which were useful for propellent, explosive and other pyrotechnic applications.

The prior use of gunpowder formulations for various pyrotechnic applications has, of course, been widespread. Likewise, the use of a wide variety of explosives is well known. Nitrate-containing gunpowder formulations and explosive compositions have been extensively researched. Many different compositions incorporating varying amounts of nitrate mixtures have been formulated and some utilized for particular ammunition, propellent and explosive applications. Even with the extensive work done over the years in the area of ammunition, explosives and propellents, few compositions have successfully achieved utility for several applications and none has successfully replaced the basic ingredients of well known gunpowder formulations and nitrated explosive compositions for general ammunition use as well as propellent and explosive applications.

Many combustible compositions which have utility as gunpowders, or explosives, or propellents or other pyrotechnic uses, employ nitrates, including organic and inorganic nitrates and ammonium nitrate, as the oxidizer portion of the composition mixture singly or sometimes in combination with other oxidizers, either as a mixture or in some chemical combination in the composition. In particular ammonium and alkali metal nitrates are employed as preferred oxidizers in many pyrotechnic formulations due to their cost and their widespread availability. Great care has to be exercised, however, in compounding formulations containing nitrates to avoid contact with easily oxidizable materials, such as many organic materials, since the flamability and potential explosive characteristic of the resultant materials has to be carefully evaluated for safety reasons. It has always been desirable to obtain pyrotechnic compositions that are safe handling and yet tend to burn predictably and completely and therefore efficiently with little ash or residue. This objective has been difficult to obtain in combination with safe handling due to powerful and often unpredictable oxidizer activity.

OBJECTS OF THE INVENTION

It is therefore an objective of the present invention to provide a new family of products which can be processed in a variety of ways to produce the kinds of results which can be utilized for a variety of applications.

It is a further objective of the present invention to provide a multiplicity of products which are useful individually as a substitute for black powder, as ammunition, with or without cases and for explosives.

It is yet a further objective of the present invention to provide products which can be molded into various shapes which have utility as gunpowder substitutes in fire arms, propellents and the like, when properly primed and ignited.

It is a further object of the present invention to provide novel compositions in molded shapes which can be used as consumable case cartridges.

It is still a further object of the present invention to provide a novel product containing organic constituents which are capable of being used as explosive and which do not have the drawbacks to safe handling present with current, widely used explosives requiring blasting caps, and the like, for detonation.

BRIEF DESCRIPTION OF THE INVENTION

Figure 1:
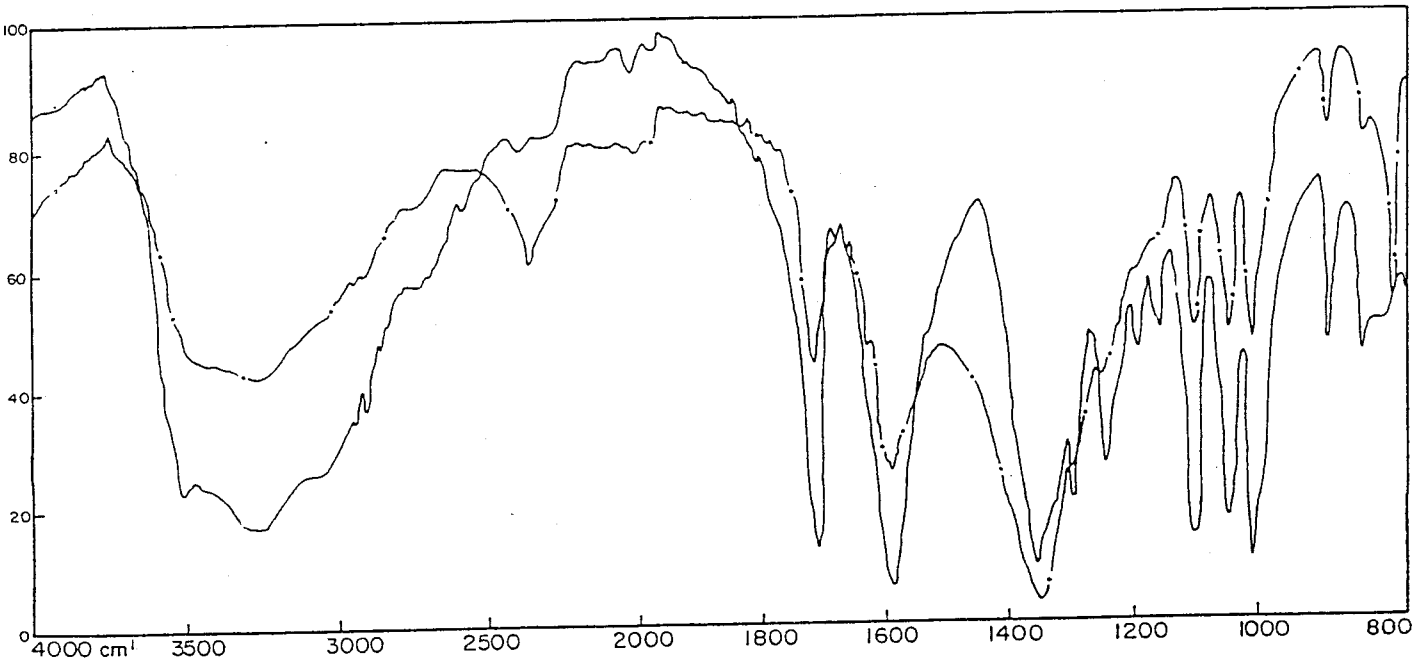
FIG. 1 is a comparison infrared spectrophotometric scan of one of the products of the present invention with added nitrate and prepared as described herein compared to an infrared scan for sodium erythorbate.

Even though much work has been done in this area, the foregoing objectives have not been achieved to the degree made possible by the products and processes of the present invention. It has been discovered that certain classes of organic compounds can be processed in a manner more fully described hereinafter to produce a variety of novel, stable nitrate-containing products which can be used as a substitute for a wide variety of gunpowder formulations, including black powder, as well as being suitable for consumable cartridges and cartridge cases, explosives and solid propellent applications. Other applications are also possible including use as either a solid or aqueous based liquid substitute for petroleum-based fuels.

In general, certain classes of organic acids, and salts of those acids and in particular ascorbic acid and erythorbic acid and the salts thereof, and mixtures thereof, which have certain antioxidant and food preservative properties, and have been found to be capable of being processed together with sources of nitrate, including inorganic nitrates, ammonium nitrate, organic nitrates, and the like, at temperatures below 480° F. to produce compositions which are capable of being molded into specific shapes or used in a powdered form as a gunpowder substitute, an explosive or a propellent when properly ignited.

It has further been discovered that the products of the present invention are surprisingly stable in air, do not easily detonate, if at all, and have measured flash point temperatures in excess of 480° F. The powdered product is, however, capable of being ignited by conventional priming compositions and procedures, when used as a gunpowder substitute, particularly when used as a replacement for black powder in a wide variety of black powder arms. Further, the reaction products, when properly contained, can be ignited by a hot wire or consumable powder ignitor and utilized as an explosive. Further still, the products, when formulated in a plastic state, as a compressed shape or as a dry powder, provide charges which are useful as a substitute for black powder in various applications, such as small or large bore ammunition or in propellent applications such as a solid propellents for rockets or for toy rockets or other firework applications, or as an aqueous based liquid fuel when dissolved in water, or in water-alcohol mixtures.

DETAILED DESCRIPTION OF THE INVENTION

Certain compounds which are naturally occurring or can be synthesized which contain basic six carbon atom glucose units or moieties thereof, such as ascorbic acid, erythorbic acid and the salts thereof have utility in the composition of the present invention. Characteristically, these acids and salts contain six carbon atoms where a carboxylic acid group is either terminal or attached to the carbon atom adjacent an oxygen bond which bridges at least two carbon atoms which are bonded with a double bond. In particular, these two carbon atoms typically are also each bonded to hydroxyl moieties. Also typically at least one additional carbon atom is also attached to a hydroxyl moiety.

The salts also typically contain water of hydration. According to the present invention, these kinds of molecules can be utilized in the composition of the present invention which includes added nitrate compounds to produce the advantages of the present invention which will be more fully described hereinafter.

Specifically, the compositions of the present invention can be obtained by utilizing commercially available compounds, as previously described, and more preferably by utilizing ascorbic acid, an alkali metal ascorbate, erythorbic acid, or an alkali metal salt thereof, and a wide variety of mixtures thereof, as described hereinafter.

Before use in the process of the present invention, it may be desirable to grind or otherwise reduce the size of the powder or crystals that are sold commercially of the foregoing compounds. Likewise, the nitrates used may be ground or otherwise reduced in size to facilitate their use in the described process, or may be used in a liquid form.

Preselected proportions of the components are then combined together either dry or in a water slurry and solution and then subjected to elevated temperatures as will be more fully described hereinafter, preferably below a temperature which would reach the flash point temperature of the composition of the present invention. Preferably, the reactants are utilized in a roughly three to one ratio wherein the nitrate containing chemical compound is used in a proportion by weight of up to about three times the proportion by weight of the organic acid or salt.

The salts of the class of organic acids described herein can be used in a similar manner with some adjustment of conditions being required due to the water of hydration normally present with the salt.

While the process described herein is intended to maximize the desired properties of the product for certain applications, it has been determined that wide variations in the process conditions are possible and still produce product having utility for many applications.

Without being bound to any specific theory for the changes that occur in the composition during the processing which produce the results described, the following observations have been made.

Figure 2:
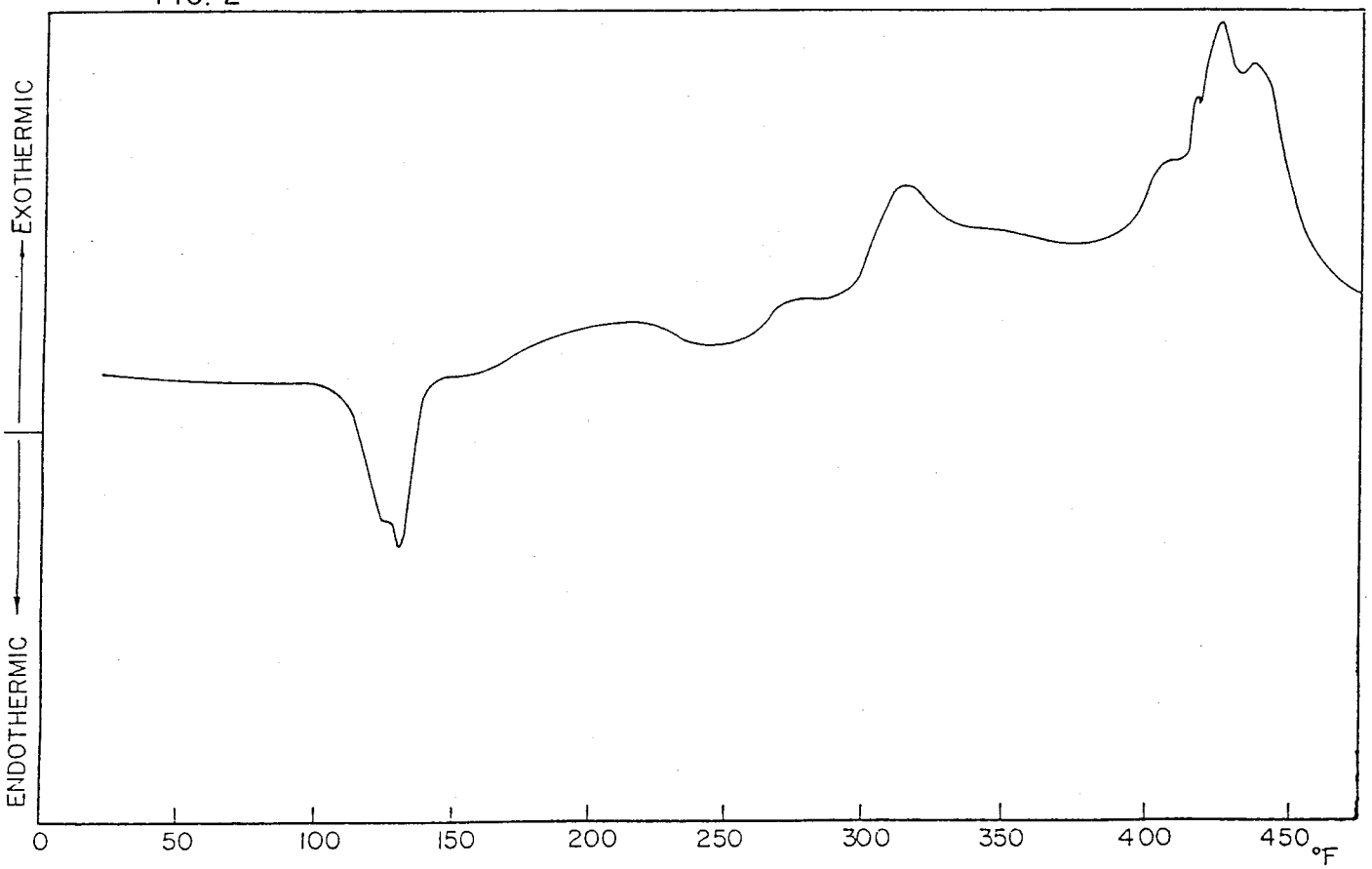
FIG. 2 is a differential thermal analysis of heating one of the formulations described herein to produce the product of the present invention.

First, as the mixture is heated, there are several observations that have been made concerning the endothermic and exothermic nature of the process. Referring to FIG. 2, a typical differential thermal analysis of the mixture during heating shows that initial heating of the solution-slurry of $KNO_3$ and sodium erythorbate drives off water, as expected at around 100° C. Further heating produces several temperature zones where exothermic phenomena are observed. These are largely explained at the present time but could be attributed to either physical or chemical changes that are occurring or both. During heating, there is, of course, some weight loss and the evolution of water vapor, carbon dioxide, nitrogen oxides, and some organic compounds such as formic acid. The exact chemical mechanisms are not known with precision, however, the infrared spectrums shown in FIG. 1 can be helpful. The solid line shows sodium erythorbate alone and the superimposed dot and dash line represents the change that occurs after heating the mixture three times with cooling between heats.

The results are tabulated in Table 1 and while not conclusive or quantitative, can be used to postulate qualitatively some of the changes that are taking place. For example, when combined with independent analytical results showing upwards of 20% to 30% unchanged sodium erythorbate, less after each remelt, it is apparent that the final product contains other constituents than the nitrate and erythorbate in the form in which they were used as starting materials. This is also consistant with ballistic results which typically are improved substantially after each remelt.

The following examples demonstrate the variety of formulations which can produce useful results for different applications, according to the present invention.

EXAMPLE I

Initially six (6) parts by weight of $KNO_3$ (Potassium Nitrate) and four (4) parts by weight of short cellulosic fibers obtained from James River Corporation (commercial designation KS 1016) are slurried together in sufficient water to form a uniform slurry or paste. Six (6) parts by weight of $KNO_3$ and four (4) parts by weight of ascorbic acid (Pharmaceutical grade obtained from Hoffman-LaRoche Company) are mixed together with a minimum sufficient quantity of water to form a clear solution. The two solutions are thoroughly mixed together and the resultant solution and slurry spread into a thin film or in a shallow container and dried. Preferably the formulation of each of the component parts is accomplished by first dissolving the $KNO_3$ completely each time before adding the second constituent of each part, adding further water if necessary. It is also desirable to use lukewarm water to facilitate dissolution though that is not essential to successfully prepare the final product. The mixed components are either freeze dried or dried at room temperature or at an elevated temperature as desired. If an elevated temperature is selected, it is important that the temperature be controlled to prevent the dried mixture from exceeding a temperature of approximately 480° F. During the drying process, when elevated temperatures are employed, typically a color change will occur and the dry mixture will take on a color ranging from beige to dark brown.

The mixture thus prepared may be used as a black powder substitute.

EXAMPLE II

The dried mixture of Example I can be packed into a mold, shaped, and, under a preselected pressure, sized to produce a caseless cartridge or a solid totally consumable cartridge. The dry powder can then be subjected to between 10,000 lbs. per square inch and 50,000 lbs. per square inch to produce a molded product, if desired.

In the preferred practice of the present invention, it is desirable to also provide a heated mold, again maintained at a temperature such that the temperature of the mixed constituents do not exceed a temperature of about 480° F., and preferably in the range of from 300° F. to 400° F. The heating of the mold facilitates the flow and proper compaction of the mixture during the forming process and aids in the production of a consumable cartridge case or consumable cartridge which exhibits the required physical properties for its use in either form. After the pressure compaction described, which, if properly done, produces a sturdy cartridge case without deleteriously affecting the burning properties of the composition. A conventional projectile may be seated into the end of the caseless cartridge utilizing a suitable sealing adhesive. Practically any conventional acetone based adhesive such as Duco Brand cement or modelers cement can be used as well as casein based adhesives, polyester adhesives, epoxy adhesives or the like. It is only important in the selection and use of such adhesives that a seal is produced which will withstand the rigors of normal handling as well as providing no deleterious effect during the combustion of the case or cartridge. The selection of a suitable adhesive for any particular application can be made without undo experimentation. The resultant case and projectile when properly supplied with a primer, which can be affixed in a manner similar to the projectile when received in a primer pocket provided in the case for that purpose or molded into the compressed cartridge case, will function in the same manner as a conventional cartridge case, powder and projectile combination, and will perform, without leaving significant residue in the bore of the weapon and with similar and with some some formulations superior ballistic performance over that obtained from conventional ammunition. In the preferred practice of the present invention, the cartridge case with an integral or conventional primer and with the projectile adhesively applied can then coated externally, if desired, with a water repellent resin such as fluid silicone such as Dow Corning 1107 fluid which has been catalyzed with Dow Corning XY 176 catalyst to provide a smooth water repellent exterior surface for the combined structure. The cartridge should, of course, conform in physical dimensions to the planned use for the cartridge with the integral primer or conventional primer and primer pocket cup and the projectile receiving end of the cartridge being shaped and sized for close approximation of the necessary dimensions for receiving a primer and projectile in the proper relationship to accomplish the desired results in a firearm.

EXAMPLE III

The composition of Example I may also be formed under pressure as described in Example II into a cartridge case into which a primer pocket is formed as described and a projectile can be received as described and where in addition the walls of the cartridge are formed so as to provide an open space from the projectile end of the cartridge to the exposed primer so that the space provided can be used to contain a power or propellent of choice other than the solid formed consumable cartridge. The powder of choice may be selected from conventional gun powders or even use the powder formulations of the present invention to achieve the desired burning rate, chamber pressures and ballistic performance.

EXAMPLE IV

The composition of Example I is prepared substituting erythorbic acid in place of ascorbic acid to achieve the same results described.

EXAMPLE V

The dried mixture of Example IV can be packed into a mold, shaped, and sized to produce a caseless cartridge or a solid totally consumable cartridge, as described in Example II. The resultant case and projectile when properly primed, will function in the same manner as a conventional primer cartridge case, powder and projectile combination, which after firing will leave no significant residue in the bore of the weapon and with similar if not superior ballistic performance.

EXAMPLE VI

A 200 gram dry mixture of 62 parts by weight of potassium nitrate, 34 parts by weight of ascorbic acid and 4 parts by weight of technical grade sodium erythorbate is slurried in about 60 ml of distilled water. The slurry is then heated at a temperature above about 320° F. and under 480° F. As the mixture is heated it is frequently stirred to insure thorough heating. During the heating, water vapor is evolved from the heated mixture. As the mixture dries, it will exhibit a color change from white to beige to a darker brown shade. Under some circumstances, some carbonization will occur which should be minimized but normally if not significantly will not deleterious effect the properties of the final product. When the mixture has dried during heating without excessive carbonization, it is cooled to room temperature. If properly heated and cooled, the mixture when cool will be hard and brittle. The mixture is then ground and screened to a preselected size, for example by successive screening to 45 mesh. The cooling, grinding and screening is preferably conducted in a low humidity atmosphere. This product can then be utilized directly on an equal volume and equal weight basis as a substitute for conventional black powder or black powder substitutes.

EXAMPLE VII

The process of Example VI is repeated using erythorbic acid in place of ascorbic acid.

EXAMPLE VIII

The process of Example VI is repeated using sodium erythorbate in place of ascorbic acid.

EXAMPLE IX

The process of Example VI is repeated using sodium ascorbate in place of ascorbic acid.

EXAMPLE X

The process of Example VI is repeated using 38 parts by weight of a 50–50 mixture of erythorbic acid and sodium erythorbate.

EXAMPLE XI

The process of Example VI is repeated using 38 parts by weight of a 75–25 mixture of erythorbic acid and sodium ascorbate.

EXAMPLE XII

The process of Example VI is repeated using 38 parts by weight of a 50–50 mixture of ascorbic acid and sodium erythorbate.

EXAMAPLE XIII

The process of Example VI is repeated using 38 parts by weight of a 75–25 mixture of ascorbic acid and sodium erythorbate.

The product of Examples VI through XVI can be melted and cooled successively to improve the performance of the product.

EXAMPLE XVII

A 200 gm mixture containing 75% by weight $KNO_3$ and 25% by weight sodium erythorbate was slurried in 60 ml of water and heated with stirring in an open container in an oil bath at 320° F. During the heating process, the mixture undergoes several visable changes. At first the slurry appears to lose water and becomes stiffer to stir. Further heating produces a products with a taffy-like consistency that can be molded under pressure into predetermined shapes. Still further heating produces an expansion of the product into a friable mass which, when cool, can be ground or otherwise reduced to a powder for use or subsequent processing.

The ground powder at a mesh size of from between about 20 mesh to 45 mesh can be used as a substitute for black powder with physical properties which will produce from between about 900 fps to about 1600 fps from a Sharps muzzle loading rifle using a charge equivalent in volume to the specifications for black powder.

The same composition can be made to undergo further reaction by heating the powder again to a temperature from between about 300° F. to about 400° F. until the powder has melted or begun to soften sufficiently to be further mixed. The subsequently heated mass is then cooled and is ground again into a powder as before for use as previously described. A first remelt produces an improved ballistic performance over the first melt. A second remelt will produce an even further improvement; a third remelt will product still further improvement. Analysis of the melts for unchanged erythorbate indicated that progressively less erythorbate is present after each remelt.

EXAMPLE XVIII

In another embodiment, the method according to the present invention, using the nitrates and organic acids or salts previously described can be mixed together under preselected temperatures and pressures in an extruder to produce a friable solid which can be ground and sized for use directly as a powder, or compressed as described herein to form a shaped charge capable of being used as a consumable cartridge case, a solid black powder substitute, or as a solid propellent. A suitable extruder, either single or double screw, preferably with internally heated screws, can be employed. The dry charge of 70% by weight $KNO_3$ and 30% by weight sodium erythorbate is fed into the inlet of the screw feed, which is operated a sufficient speed, pressure and temperature to produce the previously described product.

As previously described, up to approximately 75% by weight of the $KNO_3$ can be utilized in the process described herein, and up to 50% by weight of ascorbic or erythorbic acid or the salts thereof or mixtures thereof, or with other constituent materials not deleterious to the results sought. For purposes of calculating the proportions of constituents, the total weight of oxidizer and either one or a mixture of both acids or salts will be the reference and the proportion of oxidizer and acid to that total is calculated as either the acid or an acid salt. From the examples, it can be seen that other materials, such as short cellulosic fibers, nylon, polyester or other manmade fibers, can be encorporated in an amount found to be suitable for the described handling, forming and combustion characteristics. In the compositions of the present invention, it has been discovered that the preferred proportions of the acid component during the process conditions previously described, can vary between about 25% to 50% by weight as described and the nitrate oxidizer component employed can be used in amounts of from about 50% to 75% by weight and still achieve the beneficial results described. Different performance characteristics may be desired for different applications and the compositions may be adjusted and tested without undue experimentation to achieve the results sought.

The composition of the present invention, prepared as described, will produce a combustible mixture which has the utilities described. Without being bound by any specific theory, at the present time, it is postulated that the products of the heating step comprise a complex mixture of compounds which may include decomposition products of the starting organic compounds, condensation products and unreacted starting materials which in combination produce the desired results.

It will be appreciated from the foregoing descriptions that, depending on the end use sought, practically any chemical compound containing a nitrate moiety which will produce the results obtained in the process described with the class of organic acids or salts or derivatives thereof and mixtures thereof can be used in a wide variety of formulations having the utilities described herein. The most preferred organic acids or salts are ascorbic acid, salts thereof and erythorbic acid and salts thereof, but mixtures of these and other glucose based compounds or compositions can have utility in the present invention.

As previously described, these particular organic acids have the empirical formula $C_6H_8O_6$. It is believed that compounds having six carbon atoms or more with similar performance under the conditions described herein can produce useful formulations. Again, the product described can be produced from a wide variety of formulations to produce the kinds of results described without undue experimentation.

Also, the products of the present invention have been found to resist detonation and have a flash point above 480° F., making them easier to handle, store and transport than conventional gun powders and explosives. Tests involving the final product of Examples VI through XVII can be conducted by utilizing a conventional blasting cap without detonation of the powder. Likewise, similar compositions in a contained charge have been immersed in an oil bath at about 510° F. for 3 hours without incident and without deterioration of the explosive properties of the product.

The method of manufacture described has been found to satisfactorily produce the specific results sought with these ranges of starting materials. Different requirements including higher or lower chamber pressures and different ballistic characteristics can again be obtained by varying the composition, the additives, the primer and the weight or other characteristics of the projectile utilizing known techniques used in the ammunition industry again without undue experimentation.

The foregoing description of possible embodiments of the present invention are therefore exemplary only. It is possible within the scope of this disclosure to produce a very wide variety of specific compositions capable of functioning in many specific applications including, pyrotechnics, propellents and gun powder substitution applications as well as the consumable cartridge case and consumable cartridge described. This invention is therefore limited only by the prior art and the appended claims.

TABLE 1

| Infrared Frequency ($cm^{-1}$) | Characteristic |
|---|---|
| 3500-3000 | O—H Stretch |
| 2960 & 2940 | C—H Stretch |
| 1740 | C=O Stretch |
| 1620 | C=Stretch (Conjugated) |
| 1390 | C—H Bending |
| 1140, 1090, & 1050 | C—O, & C—O—C Stretching |
| 1380 | $NO_3^-$ (inorganic) |
| 824 | $NO_3^-$ (inorganic) |

| | Peak Ratio (Absorbance Units) | | | |
|---|---|---|---|---|
| Sample | 1740 $cm^{-1}$ | 1620 $cm^{-1}$ | 1380 $cm^{-1}$ | 824 $cm^{-1}$ |
| Sodium Erythorbate | 57.5 | 59 | 56* | — |
| Test Batch | 31 | 28 | 47 | 33 |
| Batch #1 1st Re-melt | 31 | 31 | 53 | 34 |
| Batch #1 2nd Re-melt | 29 | 30 | 55.5 | 34.5 |

*At 1390 $cm^{-1}$ for organic absorption.

What is claimed is:

1. A consumable cartridge comprising:
(a) priming means
(b) projectile means; and
(c) a molded cartridge case containing said priming means for receiving said projectile for use in a firearm, said molded cartridge case consisting essentially of a composition produced by heating a mixture comprising nitrate-containing oxidizer and an organic acid or acid salt or mixtures thereof selected from the group consisting of ascorbic acid, erythorbic acid and alkali metal salts and alkaline earth salts thereof, to a temperature below about 480° F. but sufficiently high to initiate an observable reaction.

2. The consumable cartridge of claim 1 wherein the nitrate-containing oxidizer and said organic component before being molded into a cartridge shape are present initially in amounts which when compared to the total weight of these two constituents, the nitrate-containing oxidizer component comprises from about 50% to 75% by weight and the organic component comprises from about 25% to 50% by weight before the process of being molded.

3. The consumable cartridge of claim 2 wherein the nitrate-containing oxidizer is an alkali or alkaline earth nitrate, ammonium nitrate or mixtures thereof.

4. A method of making a consumable cartridge comprising the steps of (1) forming a slurry and solution of a nitrate-containing oxidizer and an organic acid, salt, or mixtures thereof selected from the group consisting of ascorbic acid, erythorbic acid and alkali metal salts and alkaline earth salts thereof; (2) heating the slurry and solution mixture at a temperature below about 480° F. but at a temperature high enough to produce a color change and for a sufficient period of time to become a pliable mass; and, (3) compacting the mixture in a mold to a preselected shape using between 10,000 lbs. per square inch and 50,000 lbs. per square inch.

5. The method of claim 4 wherein said step of compacting includes heating the mixture while compacting to a temperature less than about 480° F.

6. The method of claim 4 wherein the step of compacting includes heating the mixture while compacting, to a temperature in the range of from about 300° F. to 400° F.

7. The method of claim 4 wherein the slurry and solution includes cellulosic or manmade fibers.

8. A method of making a consumable shaped solid comprising the steps of (1) forming a slurry and solution of a nitrate-containing oxidizer component and an organic component consisting of an organic acid, acid salt, or mixtures thereof selected from the group consisting of ascorbic acid, erythorbic acid and alkali metal salts and alkaline earth salts thereof; (2) heating the slurry and solution at a temperature of from between about 300° F. to about 400° F. until reacted; (3) cooling the dried material; (4) grinding the dried material to a preselected size; and (5) compacting the material into a preselected shape under sufficient pressure to form a finished solid which when properly ignited and burned is essentially totally consumed.

9. A consumable cartridge case comprising:
a molded cartridge case containing priming means and means for receiving a projectile in association therewith for use in a firearm, said molded cartridge case having a generally cylindrical shape comprising:
a shaped composition comprising the reaction product of heating a mixture of an inorganic nitrate oxidizer and an organic component consisting of an organic acid, acid salt, or mixtures thereof selected from the group consisting of ascorbic acid, erythorbic acid and the alkali metal salts and alkaline earth salts thereof.

10. The consumable cartridge case of claim 9 wherein the inorganic nitrate and organic component are introduced into the molded cartridge case in amounts which when compared to the total weight of these two components, the nitrate comprises from about 50% to 75% by weight and the organic acid or acid salt or mixtures thereof comprises from about 25% to 50% by weight of the total weight of these two components.

11. The consumable cartridge case of claim 10 wherein the inorganic nitrate is selected from the group consisting of potassium nitrate, ammonium nitrate and mixtures thereof.

12. The consumable cartridge case of claim 11 wherein the organic acid or acid salt is ascorbic acid, alkali metal ascorbate, erythorbic acid, alkali metal erythorbate, and mixtures thereof.

13. A method of making a consumable cartridge case comprising the steps of (1) forming a slurry and solution in water of a nitrate containing oxidizer and an organic component consisting of organic acids, organic acid salts and mixtures thereof selected from the group consisting of ascorbic acid, erythorbic acid, alkali metal ascorbate salts, alkaline earth ascorbate salts, alkali metal erythorbate salts and alkaline earth erythorbate salts; (2) heating the slurry and solution mixture at a temperature below about 480° F. from a sufficient period of time to react; and, (3) compressing the mixture in a mold to a preselected generally hollow cylindrical shape using sufficient pressure to form the finished shape.

14. The method of claim 13 wherein said step of compressing includes heating the mixture while compacting at a temperature less than 480° F.

15. The method of claim 14 wherein the oxidizer is potassium nitrate and the acid or acid salt is erythorbic acid, alkali metal erythorbate, ascorbic acid, alkali metal ascorbate or mixtures thereof.

16. The method of claim 15 wherein the slurry and solution includes cellulosic or manmade fibers.

17. The method of claim 15 wherein the consumable cartridge is formed by compressing the heated slurry into a finished shape to include integrally cellulosic or manmade fibers or fiber constructs.

18. A gunpowder substitute comprising:

the product of heating a mixture of nitrate-containing oxidizer and an organic acid or acid salt or mixture thereof wherein the organic acid has the empirical formula $C_6H_8O_6$.

19. The gunpowder substituted of claim 18 wherein the nitrate-containing oxidizer and the organic component are present initially in amounts when compared to the total weight of these two constituents, the nitrate comprises from about 50% to 75% by weight and the organic component comprises from about 25% to 50% by weight.

20. The gunpowder substitute of claim 19 wherein the nitrate-containing oxidizer, is an alkali metal nitrate, an alkaline earth nitrate, ammonium nitrate and mixtures thereof.

21. The gunpowder substitute of claim 20 wherein the organic component is selected from the group consisting of ascorbic acid, alkali metal ascorbate, erythorbic acid, alkali metal erythorbate and mixtures thereof.

22. A method of making a pyrotechnic composition comprising the steps of (1) forming a slurry and solution of an oxidizer and an organic component; (2) heating the slurry and solution mixture at a temperature below about 480° F. for a sufficient period of time to react; (3) cooling the reacted mixture to product a friable solid; and (4) grinding the solid into a powder form.

23. The method of claim 22 wherein the oxidizer is potassium nitrate and the organic component is an acid or acid salt of erythorbate acid, ascorbic acid or mixtures thereof.

24. The method of claim 23 wherein the slurry and solution includes cellulosic fibers or manmade fibers.

25. An explosive composition comprising in a major proportion, the product of heating a mixture of 50%–75% by weight of $KNO_3$ and 25%–50% by weight of an organic acid or salt or mixture thereof wherein the organic acid has the empirical formula $C_6H_8O_6$.

26. The composition of claim 25 wherein the mixture is substantially uniformly heated to a temperature less than 480° F., for a sufficient period of time for the mixture to exhibit overall change in color from white to a dark red brown color.

27. The composition of claim 26 wherein the mixture is heated to a temperature of from about 300° F. to about 400° F.

28. A composition suitable for use as a solid propellent comprising in a major proportion, the product of heating a mixture of 50%–75% by weight of $KNO_3$ and 25%–50% by weight of an organic acid or salt or mixtures thereof wherein the organic acid has the empirical formula $C_6H_8O_6$, for a sufficient period of time and at a sufficient temperature to produce a product having a flashpoint in excess of about 480° F., capable of being used as an explosive or a gunpowder substitute.

29. The composition of claim 28 wherein the mixture is substantially uniformly heated to a temperature less than 480° F., for a sufficient period of time for the mixture to exhibit overall change in color from white to a dark red brown color.

30. The composition of claim 28 wherein the mixture is heated to a temperature of from about 300° F. to about 400° F.

31. A composition suitable for use as a gunpowder substitute, a propellent, explosive and the like comprising the product of subjecting a mixture of an inorganic nitrate and an organic acid compound exhibiting antioxidant properties, wherein the organic acid has the empirical formula $C_6H_8O_6$; to a sufficient temperature, for a sufficient period of time and under sufficient pressure to form a reaction product which after cooling is a friable solid having a flash point in excess of 480° F.

32. A method of continuously producing a composition suitable for use as a gunpowder substitute, a propellent, explosive and the like comprising the steps of coextruding a mixture of an inorganic nitrate and an organic acid compound exhibiting antioxidant properties wherein the organic acid has the empirical formula $C_6H_8O_6$; to a sufficient temperature, for a sufficient period of time and under sufficient pressure to form a reaction product which after cooling a is friable solid having a flash point in excess of 480° F.

33. The method of claim 22 wherein said powder derived from said ground solid is (5) recompacted to a preselected specific granulation size.

34. The method of claim 22 wherein the cooled friable solid is recompacted prior to the step of grinding.

35. The method of claim 34 wherein said powder derived from said ground solid is (5) recompacted to a preselected specific granulation size.

* * * * *